US005828727A

United States Patent [19]

Schild

[11] Patent Number: 5,828,727

[45] Date of Patent: Oct. 27, 1998

[54] X-RAY TUBE

[75] Inventor: Markus Schild, Erlangen, Germany

[73] Assignee: Siemens Aktiengesellschaft, Munich, Germany

[21] Appl. No.: 887,192

[22] Filed: Jul. 2, 1997

[30] Foreign Application Priority Data

Jul. 4, 1996 [DE] Germany ..... 196 27 025.1

[51] Int. Cl.[6] ..... H01J 35/18

[52] U.S. Cl. ..... 378/140; 378/121

[58] Field of Search ..... 378/121, 125, 378/137, 140, 144

[56] References Cited

U.S. PATENT DOCUMENTS 4,468,802 8/1984 Friedel ..... 378/140

5,689,541 11/1997 Schardt ..... 378/140

*Primary Examiner*—David P. Porta
*Assistant Examiner*—David Vernon Bruce
*Attorney, Agent, or Firm*—Hill & Simpson

[57] ABSTRACT

An X-ray tube has a vacuum housing that accepts a cathode and an anode and that is provided with an electrically conductive beam exit window. During operation of the X-ray tube, the beam exit window lies at a negative potential and is electrically conductively connected via a resistance to a potential that is positive relative to the negative potential, this resistance being dimensioned such that, during operation of the X-ray tube, the difference in potential between the negative potential of the beam exit window and the positive potential lies on the order of magnitude of a few kilovolts.

8 Claims, 3 Drawing Sheets

X-RAY TUBE

BACKGROUND OF THE INVENTION

1. Field of the Invention

The present invention is directed to an X-ray tube of the type having a vacuum housing accepting a cathode and an anode, and which has an electrically conductive beam exit window.

2. Description of the Prior Art

An X-ray tube of the above general type is described in U.S. Pat. No. 3,500,097.

In this known X-ray tube, the beam exit window can be destroyed in case of an excessively large electron flow of back-scattered electrons to the beam exit window. Given low power, the electrically conductive beam exit window, which is at ground potential and which is not electrically insulated from the vacuum housing, is capable of eliminating the back-scattered electrons. There are limits to this capability, however, which are established by the power densities that arise upon deceleration of the electrons. The corresponding dissipated heat must likewise be eliminated by the beam exit window and can lead to the melting of the beam exit window.

U.S. Pat. No. 2,663,812 discloses a beam exit window for an X-ray tube that is formed of an electrically insulating material and which is provided at its vacuum-facing side with an electrically conductive layer having an electrical resistance which does not amount to more than 1000 Ohms. Electrons back-scattered at low power thus can be eliminated onto the vacuum housing via the electrically conductive layer. Again, however, limits are established by the power densities that arise upon deceleration of the electrons. The corresponding dissipated heat must likewise be eliminated by the beam exit window and can lead to the cracking of the beam exit window.

At higher powers, the point of incidence of the back-scattered electrons can be displaced, by deflection with magnets, from the beam exit window to other parts of the vacuum housing. This, however, means that magnets must be attached in the inside of the vacuum housing, which is inherently undesirable if only because of the risk of influencing the primary electrons, since the magnets must be attached close to the anode dish.

As disclosed in German OS 31 07 949, there is also the possibility of providing a diaphragm of copper lying at a potential between anode potential and cathode potential, which is positive potential compared to cathode potential, and which is electrically insulated from the vacuum housing, in order to keep back-scattered electrons away from the beam exit window.

German OS 42 09 377 discloses an X-ray tube having a vacuum housing that accepts a cathode and an anode and that is provided with a beam exit window at ground potential.

X-ray tubes wherein the electron beam is emitted flat (for example at a 10° angle between the anode surface and the electron beam) for increasing the X-ray power and/or for reducing the anode load, as disclosed, for example, in U.S. Pat. No. 5,128,977, moreover, are especially problematical since the proportion of electrons back-scattered from the anode is then extremely high (80%) and the generated X-rays and the back-scattered electrons are emitted into the same solid angle element. The thermal stress on the beam exit window is thus particularly high, so that the electrons back-scattered from the anode must be collected by a separate capture electrode. A further possibility for lowering the load on the beam exit window is to rotate the beam exit window relative to the main propagation direction of the back-scattered electrons. This results in the utilization of a different solid angle element for the X-radiation, which reduces the thermal stress on the beam exit window, but also means that larger areas are non-uniformly illuminated with X-radiation.

SUMMARY OF THE INVENTION

An object of the present invention is to provide an X-ray tube of the type initially described wherein the risk of damage to the beam exit window due to the incidence of back-scattered electrons is reduced, if not substantially avoided.

According to the invention, this object is achieved by an X-ray tube having a vacuum housing accepting a cathode and an anode and which has an electrically conductive beam exit window that is at a negative potential during operation of the X-ray tube and is electrically conductively connected via a resistor to a potential that is positive with reference to the negative potential, the resistor being dimensioned such that, during operation of the X-ray tube, the difference in potential between the negative potential of the beam exit window and the positive potential is on the order of magnitude of a few kilovolts, for example about 3 to about 20 kilovolts.

Since the beam exit window is at a negative potential, it functions as a repellent and scattering element in an energy-selective fashion for the incoming, back-scattered electrons. As a result, the electrons are scattered around the beam exit window and do not strike the beam exit window, but instead strike the wall of the vacuum housing. The beam exit window is thus thermally relieved, so that the risk of damage to the beam exit window due to back-scattered electrons, if not eliminated, is nonetheless diminished. The vacuum housing is at no risk because this can be thermally and mechanically more highly stressed than the beam exit window.

The potential that is positive compared to the potential of the beam exit window is preferably equal to ground potential since no special measures for providing the potential that is positive compared to the potential of the beam exit window are then required. Since the vacuum housing usually is at ground potential, in a version of the invention the beam exit window is connected to the vacuum housing via the resistor. In order then to be able to assure the required connection of the beam exit window to the vacuum housing via the resistor in a simple way, in a further version of the invention the beam exit window is connected to the vacuum housing via an insulator member that has a coating of resistor material, preferably at an exterior surface.

In another version of the invention the vacuum housing is provided with a cooling arrangement at a region thereof surrounding the beam exit window. Even given X-ray tubes of extremely high power, it is thereby assured that the thermal load on the region of the vacuum housing struck by the electrons is not excessively high.

In another version of the invention the vacuum housing has a coating of a material with a low atomic number (atomic number $z<40$) in a region surrounding the beam exit window. It is thereby assured that the extrafocal X-radiation emanating from the regions struck by the scattered electrons is negligibly low.

The advantages of the invention an especially beneficial in an X-ray tube wherein the electron beam emanating from the cathode strikes the anode at an acute angle i.e., the angle between the surface of the anode and the electron beam is an acute angle.

DESCRIPTION OF THE PREFERRED EMBODIMENTS

Figure 1:
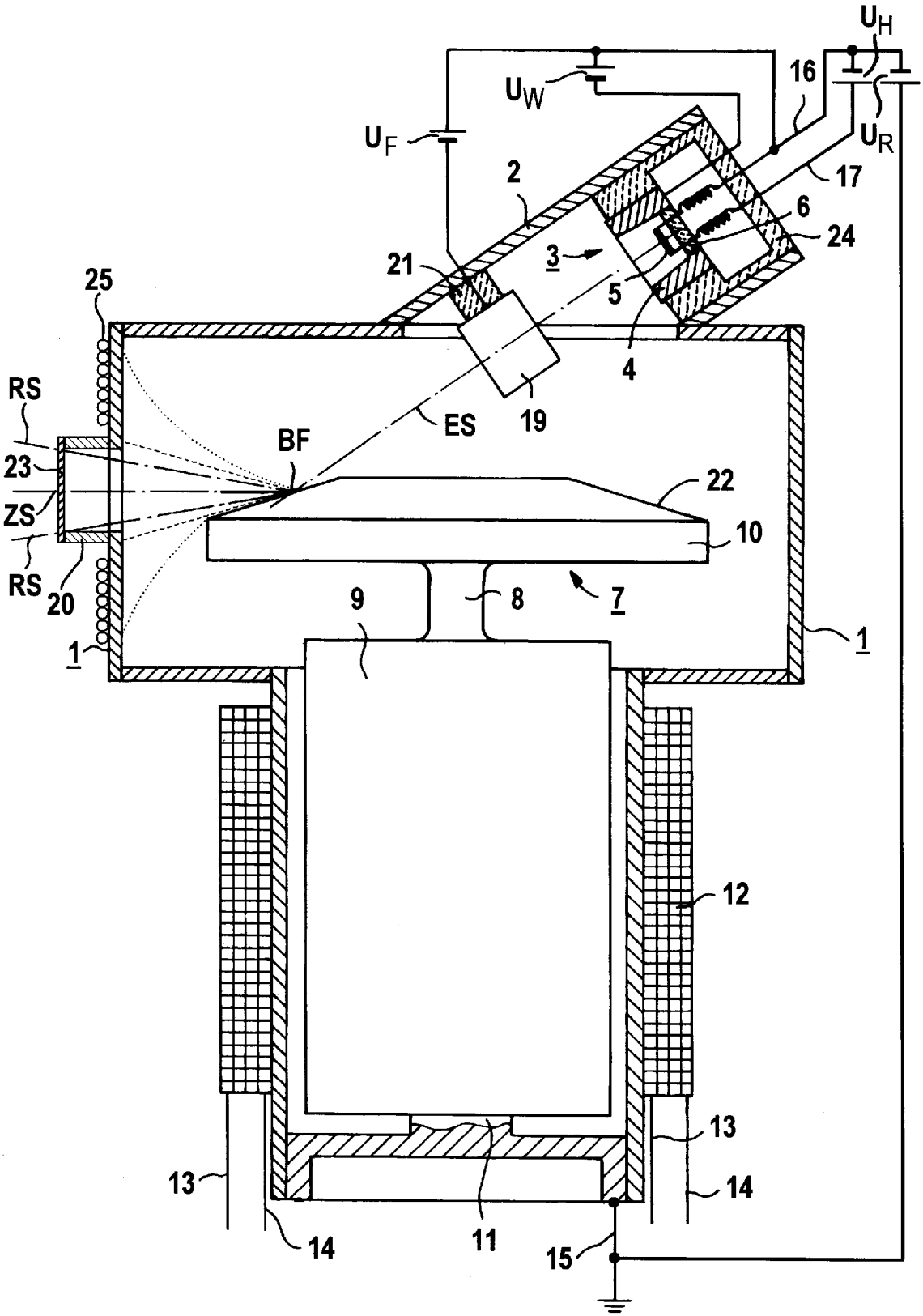
FIG. 1 shows an inventive X-ray tube in longitudinal section.

The X-ray tube shown in FIG. 1, has a vacuum housing 1 that is manufactured in a standard way of metal and ceramic or glass in the described exemplary embodiment, although the use of other materials is possible. A cathode arrangement 3 is attached in a tubular housing projection 2 within the vacuum housing 1, the cathode arrangement 3 having an electron emitter accepted within a rotationally symmetrical Wehnelt electrode 4. In the described exemplary embodiment, this electron emitter is a flat emitter in the form of a circular disk-shaped thermionic cathode 5 and is attached to the Wehnelt electrode 4 with a ceramic disk 6. A rotating anode, generally referenced 7, has an anode dish 10 connected to a rotor 9 via a shaft 8. The rotating anode 7 is disposed opposite the thermionic cathode. In a manner not shown in FIG. 1, the rotor 9 is rotatably seated on a shaft 11 connected to the vacuum housing 1. A stator 12 that interacts with the rotor 9 to form an electric motor for driving the rotating anode 7 is placed onto the outside wall of the vacuum housing 1 in the region of the rotor 9.

During operation of the X-ray tube, an alternating current is supplied to the stator 12 via lines 12 and 13, so that the anode dish 10 connected to the rotor 9 via the shaft 11 rotates.

During operation of the X-ray tube according to FIG. 1, the Wehnelt voltage $U_W$ lies between one terminal of the thermionic cathode 5 and the Wehnelt electrode 4. The tube voltage $U_R$ is applied via lines 15 and 16. The line 15 is connected to the shaft 11 that is in turn electrically conductively connected to the vacuum housing 1. The line 16 is connected to a terminal of the thermionic cathode 5. The other terminal of the thermionic cathode 5 is connected to a line 17. The filament voltage $U_H$ of the thermionic cathode 5 lies between this line 17 and the line 16, so that an electron beam ES having a circular cross-section emanates from the thermionic cathode. Only the center axis of the electron beam ES is shown in FIG. 1, but the outer contours or boundaries thereof are also indicated in FIG. 2.

The electron beam ES passes through a focusing electrode 19 attached to the vacuum housing 1 via an insulator 21. A shown in FIG. 1, a focusing voltage $U_F$ is present across this focusing electrode 19 and the terminal of the thermionic cathode 5 connected to the line 16. As indicated in FIG. 1, the electron beam ES then strikes an incident surface 22 of the anode dish 10 in a focal spot referenced BF. X-radiation emanates from the focal spot BF. The useful X-ray beam, whose central ray ZS and edge rays RS are indicated dot-dashed in FIGS. 1 and 2 emerges through a beam exit window 23.

As a result of the circular cross-section of the electron beam ES, moreover, the pre-condition is established for producing in the focal spot BF an intensity distribution of the X-radiation similar to a Gaussian curve, for arbitrary directions.

Figure 2:
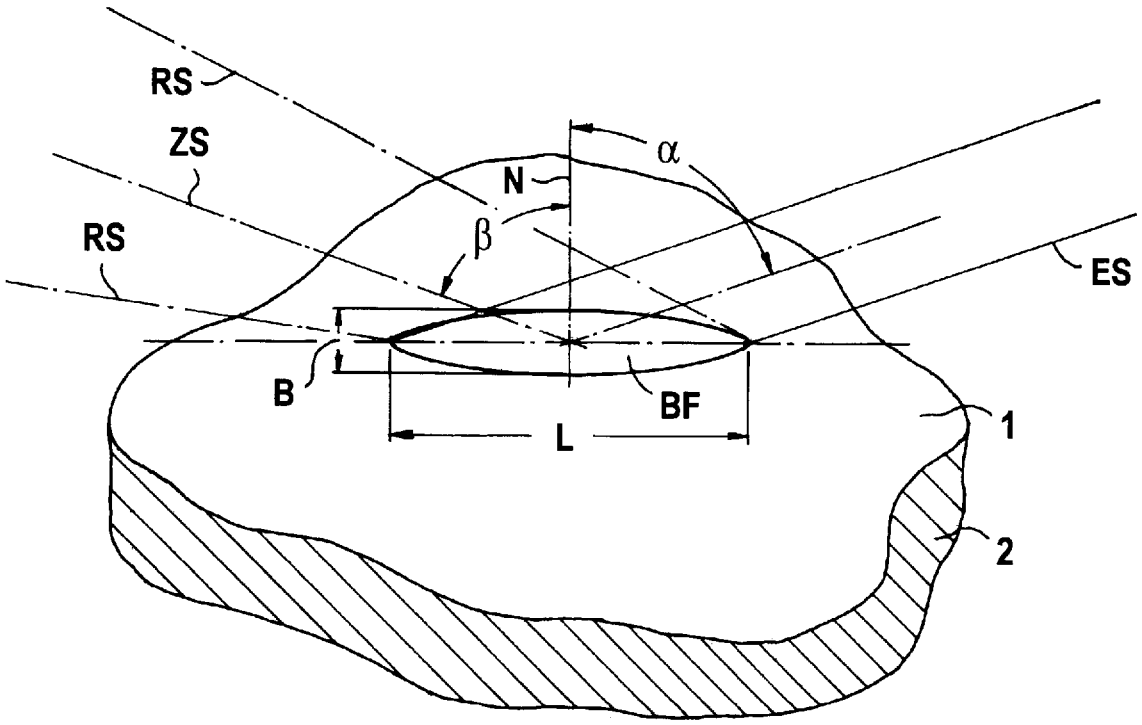
FIG. 2 shows the focal spot of the X-ray tube of FIG. 1 in an enlarged perspective view.

In order to avoid having the thermal load on the incident surface exceeding allowable limits, the electron beam ES is incident in the focal spot BF at an acute angle relative to the incident surface 22, i.e., an angle $\alpha>45°$ relative to the surface normal N of the incident surface 22, so that a line-shaped, or to be more precisely, an elliptical focal spot BF is produced (see FIG. 2). The width B of the focal spot BF corresponds to the diameter of the electron beam ES in the immediate proximity of the incident surface 22, which is dependent on the Wehnelt voltage $U_W$ and on the focusing voltage $U_F$ with a given geometry of the thermionic cathode 5, the Wehnelt electrode 4 and the focusing electrode 19, as well as with a given filament current and given tube voltage.

In view of the focal spot dimensions that are usually desired, the angle $\alpha$ is selected for producing a length L of the focal spot between 1 and 15 mm with a given diameter D of the electron beam ES of 0.1 through 2.0 mm. The indicated diameter range applies to the diameter of the electron beam ES in the immediate proximity of the incident surface 22 of the anode dish 10.

The position of the beam exit window 23 is selected such that the angle $\beta$ between the central ray ZS of the useful X-ray beam and the surface normal N of the incident surface 22 is substantially equal to the angle $\alpha$. As viewed in the direction of the central ray ZS of the useful X-ray beam, a circular focus that is beneficial for a high imaging quality is produced.

The beam exit window 23 is formed of a suitable, electrically conductive material (for example, aluminum, titanium or beryllium) and is connected to the vacuum housing 1 via a tubular insulator member 20 formed, for example, of ceramic.

Figure 3:
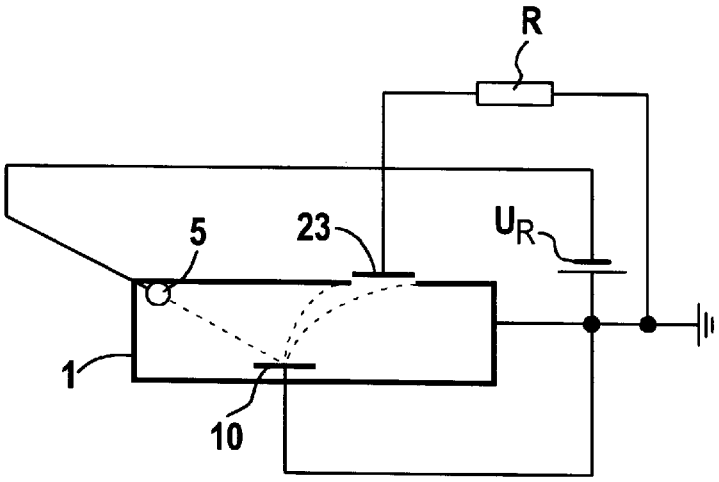
FIG. 3 shows a schematic view of the X-ray tube of FIGS. 1 and 2.

During operation of the X-ray tube—as schematically indicated in FIG. 3 —, the beam exit window 23 is applied via a resistance represented by a resistor R to a potential that is positive compared to the beam exit window 23, namely ground potential, which is the same potential as the vacuum housing 1. This potential and the value of resistance of the resistor R are selected such that, during operation of the X-ray tube, the difference in potential between the negative potential of the beam exit window 23 and the aforementioned positive potential lies on the order of magnitude of a few kilovolts, for example 5 to 25 kilovolts. As a result, the back-scattered electrons that move toward the beam exit window are repelled and scattered in an energy-selective fashion. Given a circular beam exit window 23, they are rotationally symmetrically scattered around the beam exit window 23. The electrons thus do not strike the beam exit window 23 but instead strike the region of the wall of the vacuum housing 1 surrounding the beam exit window 23.

Figure 4:
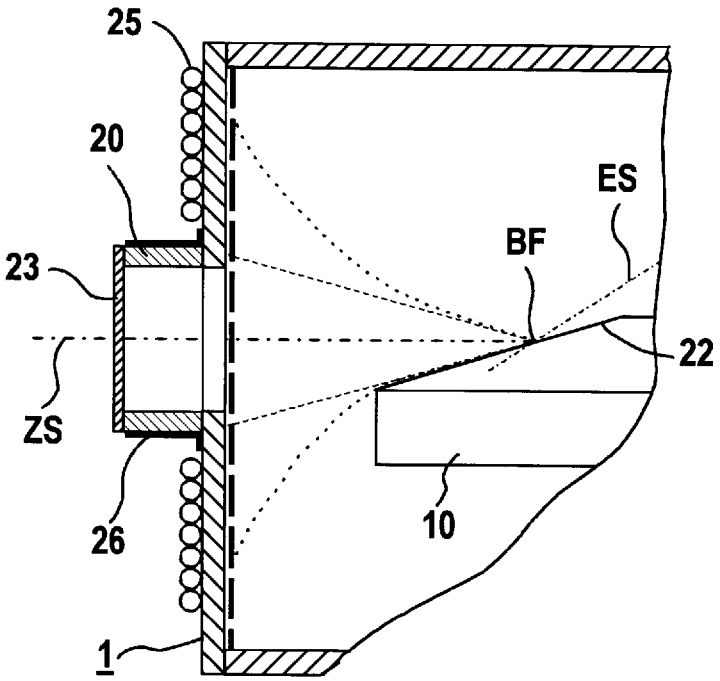
FIG. 4 shows an enlarged detail of the X-ray tube of FIGS. 1 through 3.

In the described embodiment, the resistor R is formed by an insulator member 20 that connects the beam exit window 23 to the vacuum housing 1 and whose exterior is provided with a coating 26 of a resistor material as can be seen from FIG. 4.

In the described embodiment, the region of the wall of the vacuum housing 1 surrounding the beam exit window 23 is cooled with a tube coil 25 connected (in a way not shown) to a suitable cooling unit, so that thermal overloads at the region of the vacuum housing 1 charged by the electrons are precluded.

Another factor having a beneficial effect in view of the thermal load on the wall of the vacuum housing is that, due to the scattering of the electrons onto the wall of the vacuum housing, which can already be more highly loaded than the beam exit window 23, a power density is produced that is reduced farther compared to the beam exit window of conventional X-ray tubes.

As relevant investigations have shown (see L. Reimer, Scanning Electron Microscopy, Springer-Verlag, Berlin, Heidelberg, New York, Tokyo, 1985, page 138), the electrons—without further measures—would be reflected from the incident surface 22 of the anode dish 10 in an angular range of about 30°, indicated with dashed lines in FIG. 1 given an angle $\alpha$ of 10°. Given a spacing of the focal spot BF of about 3 cm from the beam exit window 23, the corresponding dissipated power must then be eliminated via an area having a size of about 2 $cm^2$. When, by contrast, an average deflection angle of 40° is achieved by the scattering, as indicated by dotted lines in FIG. 1, then an area of about 20 $cm^2$ is available, and this area is in a region, namely the wall of the vacuum housing 1, that is more mechanically and thermally stable than the beam exit window 23 and which, moreover, can be actively cooled.

As a result of the thermal load per surface element that is lower by a factor of ten in the inventive X-ray tube, an active cooling can be foregone in certain applications, i.e. the dissipated power can be eliminated without special measures via the insulating and cooling agent, for example cooling oil, that is usually situated in the protective housing that accepts the X-ray tube.

The region of the vacuum housing 1 surrounding the beam exit window 23 is provided with a coating 27 of a material having a low atomic number (for example, carbon). It is thereby assured that the extrafocal X-radiation which emanates from the regions of the vacuum housing 1 that are struck by the electrons scattered by the beam exit window 23 will be negligible.

The average deflection angle at which the back-scattered electrons are deflected is dependent on the magnitude of the negative potential of the beam exit window 23, and thus on the value of the resistance of the resistor R, i.e., the resistance of the tube 20 or the coating 26 and on that potential with which the beam exit window 23 is connected via the resistor R (tube 20 or coating 26). (This potential can deviate from ground potential, differing from the described exemplary embodiment.)

The beam exit window need not necessarily be completely formed of an electrically conductive material as in the case of the described exemplary embodiment. Under certain circumstances, an electrically conductive coating with an adequately low impedance (for example, <500 Ohms) suffices on the inside of the window, this being connected to the positive potential via resistance represented by the resistor R.

Figure 5:
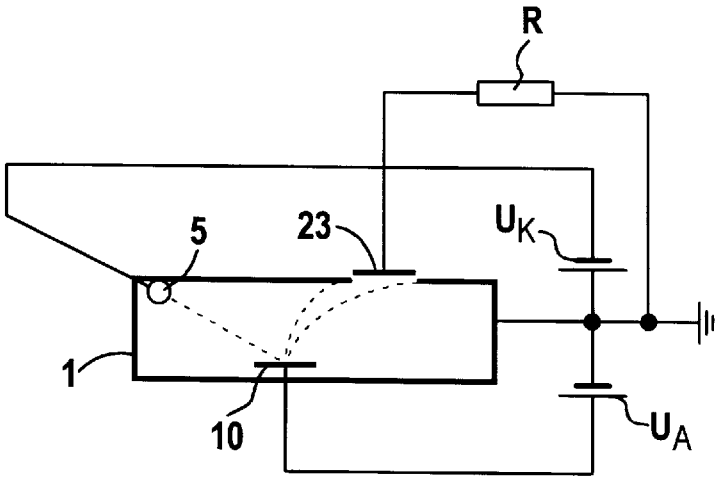
FIG. 5 shows another embodiment of the inventive X-ray tube in a manner analogous to that of FIG. 3.

The X-ray tube according to FIGS. 1 through 4 is a type known as a single-pole X-ray tube, wherein the anode dish 10 and the vacuum housing 1, as shown in FIG. 1, lie at ground potential and the cathode 3 lies at a potential $U_R$ that is negative compared to ground. The invention can also be employed in the case of two-pole X-ray tubes wherein, as schematically indicated in FIG. 5, the vacuum housing 1 lies at ground potential, the cathode 3 lies at a cathode voltage $U_K$ that is negative compared to ground, and the anode dish 10 lies at an anode voltage $U_A$ that is positive compared to ground.

The beam exit window 23 need not be connected to the vacuum housing 1 via the resistance R. It is also possible for the beam exit window 23 to be electrically insulated from the vacuum housing and connected via an ordinary electrical resistor to the positive potential (referenced to the negative potential of the beam exit window 23).

The resistance need not necessarily be formed by an insulator member provided with a coating. Instead, for example, a component of ceramic having limited electrical conductively, for example carbon doped with aluminum oxide, can form the resistance and be used to connect the beam exit window 23 to the vacuum housing 1.

The invention is also suitable for X-ray tubes wherein, differing from the described exemplary embodiment, an electron beam having a circular cross-section is not used. Alternatively to the described structure of the thermionic cathode 5, it is possible to employ a conventional thermionic cathode implemented as a coil.

The exemplary embodiment described above is a rotating anode X-ray tube, however, the invention can also be employed in X-ray tubes with a fixed anode.

Although modifications and changes may be suggested by those skilled in the art, it is the intention of the inventor to embody within the patent warranted hereon all changes and modifications as reasonably and properly come within the scope of his contribution to the art.

I claim as my invention:

1. An X-ray tube comprising:

a vacuum housing;

a cathode disposed in said vacuum housing which emits an electron beam;

an anode disposed in said vacuum housing which is struck by said electron beam and from which X-rays are emitted;

said vacuum housing having a beam exit window through which said X-rays pass;

means for placing said beam exit window at a negative first potential during operation of said X-ray tube and for electrically connecting said beam exit window via a resistance to a second potential that is positive relative to said negative potential; and said resistance having a value for, during said operation of said X-ray tube, producing a potential difference between said first potential and said second potential in a range between about 3 kilovolts and about 20 kilovolts.

2. An X-ray tube as claimed in claim 1 wherein said second potential is ground potential.

3. An X-ray tube as claimed in claim 1 wherein said beam exit window is connected to said vacuum housing via said resistance.

4. An X-ray tube as claimed in claim 3 wherein said resistance comprises an insulator member having a coating of resistive material, said insulator member connecting said beam exit window to said vacuum housing.

5. An X-ray tube as claimed in claim 2 wherein said resistance comprises an element consisting of electrically conductive ceramic connecting said beam exit window to said vacuum housing.

6. An X-ray tube as claimed in claim 1 further comprising cooling means for cooling a region of said vacuum housing surrounding said beam exit window.

7. An X-ray tube as claimed in claim 1 further comprising a coating on an interior surface of said vacuum housing surrounding said beam exit window, said coating comprising a material having a low atomic number.

8. An X-ray tube as claimed in claim 1 wherein said cathode is oriented relative to said anode in said vacuum housing for causing said electron beam to strike said anode at an acute angle.

* * * * *